US007908897B2

(12) United States Patent
Igarashi et al.

(10) Patent No.: US 7,908,897 B2
(45) Date of Patent: Mar. 22, 2011

(54) SPLINE ROLLING TOOL, AND PROCESS OF MANUFACTURING SPLINE ROLLING TOOL

(75) Inventors: Masahiko Igarashi, Mohka (JP); Hideo Watanabe, Mohka (JP); Nobuyoshi Asaga, Mohka (JP); Satoshi Komuro, Mohka (JP); Takeshi Mochizuki, Mohka (JP); Daisuke Sakurai, Mohka (JP); Manabu Igusa, Mohka (JP); Yoshihiro Umebayashi, Toyohashi (JP); Masahiro Oiwake, Toyohashi (JP)

(73) Assignees: Honda Motor Co., Ltd., Tokyo (JP); OSG Corporation, Aichi (JP)

( * ) Notice: Subject to any disclaimer, the term of this patent is extended or adjusted under 35 U.S.C. 154(b) by 613 days.

(21) Appl. No.: 11/666,466

(22) PCT Filed: Feb. 28, 2006

(86) PCT No.: PCT/JP2006/303784

§ 371 (c)(1),
(2), (4) Date: Sep. 4, 2007

(87) PCT Pub. No.: WO2006/120790

PCT Pub. Date: Nov. 16, 2006

(65) Prior Publication Data

US 2008/0104817 A1 May 8, 2008

(30) Foreign Application Priority Data

May 6, 2005 (JP) ..... 2005-134908

(51) Int. Cl.
*B21D 17/04* (2006.01)
*B21D 15/00* (2006.01)
*B21D 17/00* (2006.01)

(52) U.S. Cl. ..... 72/88; 72/102; 72/469

(58) Field of Classification Search ..... 72/88–92, 72/102–104, 469, 108; 29/893.44, 893.35; 76/107.1, 107.4; 470/8–11
See application file for complete search history.

(56) References Cited

U.S. PATENT DOCUMENTS 5,007,773 A * 4/1991 Souketani et al. ..... 407/27
6,598,453 B2 * 7/2003 Murai et al. ..... 72/469

FOREIGN PATENT DOCUMENTS

JP U 3-47709 10/1991
JP 09-308935 12/1997
JP 11-290978 10/1999
JP 2005-021994 1/2005

* cited by examiner

*Primary Examiner* — Teresa M Bonk
(74) *Attorney, Agent, or Firm* — Muramatsu & Associates

(57) ABSTRACT

A spline rolling tool including a plurality of forming teeth that are to bite into a cylindrical workpiece so as to roll splines in the workpiece. Each of the forming teeth has an incomplete toothed region in which a crest of each forming tooth is removed such that an upper end of each forming tooth in the incomplete toothed region is defined by an incomplete-toothed region surface that includes a curved surface portion, a flat surface portion and a slant surface portion. The incomplete-toothed region surface is defined at its periphery by a chamfered edge that has a surface roughness of not larger than about 3.2 μm. Also disclosed is a process of manufacturing the spline rolling tool, which includes a chamfering step of forming the chamfered edge by using a wire brush having abrasive grains that are fixed to bristles of the wire brush.

10 Claims, 8 Drawing Sheets

SPLINE ROLLING TOOL, AND PROCESS OF MANUFACTURING SPLINE ROLLING TOOL

TECHNICAL FIELD

The present invention relates to a spline rolling tool, and more particularly to such a spline rolling tool in which strength of forming teeth is so assured that durability of the forming teeth is improved and which can be manufactured at a low cost. The present invention also relates to a process of manufacturing the spline rolling tool.

BACKGROUND ART

Splines are a plurality of tooth-shaped keys provided on an outer circumferential surface of a shaft member, and are to be fitted into a member so that power (rotational force) can be transmitted through the mated members. In general, the splines are formed on an outer circumferential surface of a workpiece by a rolling operation using a rolling tool. Each of the splines can be easily broken at a longitudinal end portion of its root (at its ramped end portion). Therefore, there is a need for obtaining a torsional strength of such an easily breakable portion of the root as indicated by Japanese Application Laid-Open Publication No. JP-H11-290978 (see paragraph [0004], etc).

In view of the above need, the applicant of the present application invented a spline 100 as shown in FIG. 8 (which is not publicly known at the time of filing of the present application). As shown in FIG. 8, a shoulder 101*a* is provided in a ramped end portion of this spline 100, so that a root diameter defined by a root 101 of the spline 100 is changed in a direction of axis O (horizontal direction as seen in FIG. 8) of a shaft member. The provision of the shoulder 101*a* assures a strength of the ramped end portion, namely, makes it possible to improve the torsional strength.

In a rolling tool used for rolling the spline 100, one of widthwise end portions of each of its forming teeth is subjected to a crest removing operation (see FIG. 2), for permitting the shoulder 101*a* to be provided in the root 101 when the spline 100 is formed by the rolling tool.

DISCLOSURE OF INVENTION

Object to be Solved by the Invention

However, in this technology, since each of the forming teeth is subjected to the crest removing operation for creating an incomplete toothed region, a periphery of the incomplete toothed region becomes a sharp edge, by which each of the forming teeth (incomplete toothed region) is easily chipped or otherwise damaged. Further, since an angular portion is formed on the spline 100, a stress is easily concentrated in the angular portion. Consequently, there is a problem that durabilities of the rolling tool and the splined shaft are deteriorated.

For example, Japanese Application Laid-Open Publication No. JP-H09-308935 discloses a spline rolling tool in which a side surface of each tooth (forming tooth) is chamfered for making it possible to prevent deterioration of strength due to stress concentration. However, the chamfering is conventionally made by a handwork operation carried out by a skilled worker, thereby causing increase in time required for the handwork operation and accordingly considerable increase in cost for manufacturing the tool. Further, since the chamfering is made by the handwork operation, there is problem that a sufficient accuracy can not be obtained due to variation with respect to shape of the chamfered portion and surface roughness in the chamfered portion.

On the other hand, the periphery of the incomplete toothed region could be chamfered by a machining operation using a technique, as disclosed in JP-H11-290978 noted above, which is for moving a grinding wheel along a predetermined path. However, it would be necessary to extremely accurately control the feed movement of the grinding wheel through three controllable feed axes, in order to machine an entirety of the periphery of the incomplete toothed region having a stepped portion, such that the entirety of the periphery of the incomplete toothed region is round-chamfered. The necessity of the extremely accurate control of the feed movement of the grinding wheel leads to an increase in cost required for the control of the feed movement. Further, since such a machining operation with the extremely accurate control has to be made for each and every forming tooth, the required operation time is extremely increased, resulting in considerable increase in the overall cost for manufacturing the tool.

The present invention was developed for solving the above-described problem, and has an object to provide a spline rolling tool in which strength of forming teeth is attained so that durability of the forming teeth is improved and which can be manufactured at a low cost, and also a process of manufacturing the spline rolling tool.

Measures for Achieving the Object

For achieving the object, a first aspect of the invention is a spline rolling tool having a toothed forming face provided with a plurality of forming teeth that are to bite into an outer circumferential surface of a workpiece so as to roll splines in the outer circumferential surface of the workpiece, wherein each of the forming teeth has an incomplete toothed region which is located in one widthwise end portion thereof and which is formed by a crest removing operation, and a chamfered edge which is a periphery of the incomplete toothed region and which is formed by a chamfering operation; the incomplete toothed region has a curved surface portion located in a widthwise end portion thereof and having an arcuate cross-section, a flat surface portion contiguous to the curved surface portion and substantially parallel to a crest of each of the forming teeth, and a slant surface portion contiguous to the flat surface portion and inclined upwardly toward the other widthwise end portion of each of the forming teeth; and the chamfered edge is formed in the periphery of the incomplete toothed region to have a rounded cross-section, by rotating a wire brush having a plurality of bristles to which abrasive grains adhere and parallelly moving the wire brush in a single direction, such that the chamfered edge has a surface roughness of not larger than about 3.2 μm.

A second aspect of the invention is a process of manufacturing a spline rolling tool having a toothed forming face provided with a plurality of forming teeth that are to bite into an outer circumferential surface of a workpiece so as to roll splines on the outer circumferential surface of the workpiece, each of the forming teeth having an incomplete toothed region which is located in one of widthwise end portions thereof and which is formed by a crest removing operation, and a chamfered edge which is a periphery of the incomplete toothed region and which is formed by a chamfering operation, comprising the steps of: forming the forming teeth in the toothed forming face of the spline rolling tool by using a grinding wheel; subjecting the forming teeth to a crest removing operation using a grinding wheel for forming the incomplete toothed region having a curved surface portion located in a widthwise end portion thereof and having an arcuate cross-section, a flat surface portion contiguous to the curved surface portion and substantially parallel to a crest of each of the forming teeth, and a slant surface portion contiguous to the flat surface portion and inclined upwardly toward the other widthwise end portion of each of the forming teeth; and subjecting the incomplete toothed region to a chamfering operation using a wire brush having a plurality of bristles to which abrasive grains adhere so as to form the chamfered edge in the periphery of the incomplete toothed region such that the chamfered edge has a rounded cross-section and a surface roughness of not larger than about 3.2 μm, wherein the chamfering step is implemented by rotating and parallelly moving the wire brush in a single direction.

According to a third aspect of the invention, in the process defined in the second aspect of the invention, the direction is a direction that is substantially perpendicular to a width direction of each of the forming teeth.

Effects of the Invention

In the spline rolling tool of the present invention, since the incomplete toothed region having the curved surface portion, the flat surface portion and the slant surface portion are located in one of the widthwise end portions of each of the forming teeth, roots of the respective splines can be formed such that a root diameter defined by the roots of the respective splines is changed in an axial direction of the workpiece, and a shoulder having a large diameter can be provided in a ramped end portion of each of the splines. Therefore, it is possible to roll the splines in each of which a torsional strength of the ramped end portion is improved.

If the incomplete toothed region is simply created on each of the forming teeth, the periphery of the incomplete toothed region would become a sharp edge whereby durabilities of the forming teeth and splines could be reduced. However, in the spline rolling tool of the present invention, the periphery of the incomplete toothed region is subjected to the chamfering operation, so that the chamfered edge is formed in the periphery of the incomplete toothed region to establish a rounded cross-section with the surface roughness of not larger than about 3.2 μm. Therefore, it is possible to restrain each of the forming teeth from being chipped or otherwise damaged and accordingly to improve the durability of the spline rolling tool per se.

On the other hand, when the splines are rolled in the workpiece, it is possible to restrain formation of an angular portion in the ramped end portion of each of the splines and accordingly to improve a surface smoothness of the ramped end portion. Therefore, there is an effect that the splines each having a high strength can be rolled in the workpiece. Consequently, the durability of each of the splines can be improved.

Further, the chamfered edge is formed by rotating the wire brush having the plurality of bristles to which abrasive grains adhere and parallelly moving the wire brush in the above noted direction. Therefore, even in a case where the incomplete toothed region has a complicated shape with the curved surface portion, the flat surface portion and the slant surface portion as in the present invention, it is possible to cause the bristles to be flexed to follow the complicated shape of the incomplete toothed region. Accordingly, it is possible to efficiently and accurately form the chamfered edge having the rounded cross-section with the surface roughness of not larger than about 3.2 μm in the periphery of the incomplete toothed region.

Consequently, it is possible to uniformly form the chamfered edge having the rounded cross-section, and accordingly to avoid the problem of increase in variation in the shape and surface roughness of the chamfered portion, which problem has been encountered in the conventional product requiring the handwork operation to form the chamfered portion therein. Therefore, it is possible to restrain chipping or other damage of each of the forming teeth and also to roll the splines each having a high strength, restraining formation of an angular portion in the ramped end portion of each of the splines.

Further, it is possible to improve accuracy in the shape of each of the forming teeth, and to avoid the problem of reduction in a non-chamfered portion of each of the forming teeth, which problem has been encountered in a conventional product in which each of the forming teeth has been likely to be chamfered too much in the chamfering operation. Therefore, there is also an effect that it is possible to roll the splines each having a high accuracy, and accordingly to improve accuracy in fitting of each of the splines.

Further, since the chamfered edge is formed by parallelly moving the wire brush in the single direction, the chamfered edge can be formed in an extremely short length of time. That is, it is not necessary to carry out a complicated operation such as a machining operation with use of a numerically controlled machine tool in which a grinding wheel is fed through a three controllable axes of the machine tool so as to be moved along the periphery of the incomplete toothed region of each of the multiplicity of forming teeth provided in the toothed forming face. Thus, the chamfered edges can be formed in the multiplicity of forming teeth at a time. Consequently, it is possible to simplify the chamfering step and accordingly to reduce a time required to carry out the chamfering operation, thereby leading to reduction in the machining cost. Therefore, there is an effect that is it possible to reduce cost required for the entirety of the spline rolling tool as a product.

In the spline-rolling-tool manufacturing process of the present invention, since the crest removing step is implemented to form the incomplete toothed region having the curved surface portion, the flat surface portion and the slant surface portion in the one widthwise end portion of each of the forming teeth, it is possible to manufacture the spline rolling tool capable of rolling the splines in each of which a root diameter defined by roots of the respective splines is changed in an axial direction of the workpiece. That is, by using the spline rolling tool, it is possible to roll the splines in each of which a shoulder having a large diameter is provided in a ramped end portion of the spline so that a torsional strength of the ramped end portion is improved.

If the forming teeth are subjected to the crest removing operation performed by the grinding wheel in the crest removing step, the periphery of the incomplete toothed region would become a sharp edge whereby durabilities of the forming teeth and splines could be reduced. However, in the spline-rolling-tool manufacturing process of the present invention, the chamfering step is implemented whereby the chamfered edge is formed throughout the periphery of the incomplete toothed region to have a rounded cross-section and the surface roughness of not larger than about 3.2 μm. Therefore, it is possible to restrain each of the forming teeth from being chipped or otherwise damaged and accordingly to manufacture the spline rolling tool of high durability.

Since the splines are rolled in the workpiece by using the spline rolling tool having the above-described chamfered edge in the periphery of the incomplete toothed region, it is possible to restrain formation of an angular portion in the ramped end portion of each of the splines and also to improve a surface smoothness of the ramped end portion. Therefore, in the spline-rolling-tool manufacturing process of the present invention, there is an effect that it is possible to manufacture the spline rolling tool capable of rolling the splines each having a high strength in the workpiece.

Further, in the chamfering step, the incomplete toothed region formed in the crest removing step is subjected to the chamfering operation using the wire brush having the plurality of bristles to which the abrasive grains adhere, whereby the chamfered edge is formed in the periphery of the incomplete toothed region such that the chamfered edge has the rounded cross section and the surface roughness thereof is not larger than about 3.2 μm.

Therefore, even in a case where the incomplete toothed region has a complicated shape with the curved surface portion, the flat surface portion and the slant surface portion as in the present invention, it is possible to cause the bristles to be flexed to follow the complicated shape of the incomplete toothed region. Accordingly, it is possible to efficiently and accurately form the chamfered edge having the rounded cross-section with the surface roughness of not larger than about 3.2 μm in the periphery of the incomplete toothed region.

Consequently, it is possible to uniformly form the chamfered edge having the rounded cross-section, and accordingly to avoid the problem of increase in variation in the shape and surface roughness of the chamfered portion, which problem has been encountered in the conventional manufacturing process requiring the handwork operation to form the chamfered portion therein. Therefore, it is possible to restrain chipping or other damage of each of the forming teeth and accordingly to improve durability of the spline rolling tool.

Further, by using this spline rolling tool, it is possible to restrain formation of an angular portion in the ramped end portion of each of the splines and also to improve a surface smoothness of a rolled surface of the workpiece. Therefore, there is an effect that the splines each having a high strength can be rolled in the workpiece.

Further, in a conventional manufacturing process, there has been a problem of reduction in a non-chamfered portion of each of the forming teeth, since each of the forming teeth has been likely to be chamfered too much in the chamfering operation. However, in the manufacturing process of the present invention in which the wire brush is caused to cut an angular portion of each of the forming teeth having a relatively low rigidity, there is an effect that it is possible to assuredly obtain a non-chamfered portion of each of the forming teeth. Therefore, since accuracy in the shape of each of the forming teeth can be improved, there is an effect that it is possible to roll the splines each having a high accuracy, and accordingly to improve accuracy in fitting of each of the splines.

Further, since the chamfering step is performed by rotating and parallelly moving the wire brush in the single direction, the chamfered edge can be formed in an extremely short length of time. That is, it is not necessary to carry out a complicated operation such as a machining operation with use of a numerically controlled machine tool in which a grinding wheel is fed through a three controllable axes of the machine tool so as to be moved along the periphery of the incomplete toothed region of each of the multiplicity of forming teeth provided in the toothed forming face. Thus, the chamfered edges can be formed in the multiplicity of forming teeth at one time. Consequently, it is possible to simplify the chamfering step and accordingly to reduce a time required to carry out the chamfering operation, thereby leading to reduction in the machining cost. Therefore, there is an effect that it is possible to reduce cost required for manufacturing the spline rolling tool.

In the spline-rolling-tool manufacturing process of the present invention, in addition to the effects provided by the spline-rolling-tool manufacturing process noted above, there is an effect that it is possible to cause each of the bristles of the wire brush to be appropriately brought into contact with the periphery of the incomplete toothed region and accordingly to highly efficiently and reliably carry out the chamfering operation even in a case where the incomplete toothed region has a complicated shape with the curved surface portion, the flat surface portion and the slant surface portion as in the present invention, since the wire brush is moved in the direction (the single direction) that is substantially perpendicular to the width direction of each of the forming teeth.

EXPLANATION OF REFERENCE SIGNS

Figure 1A:
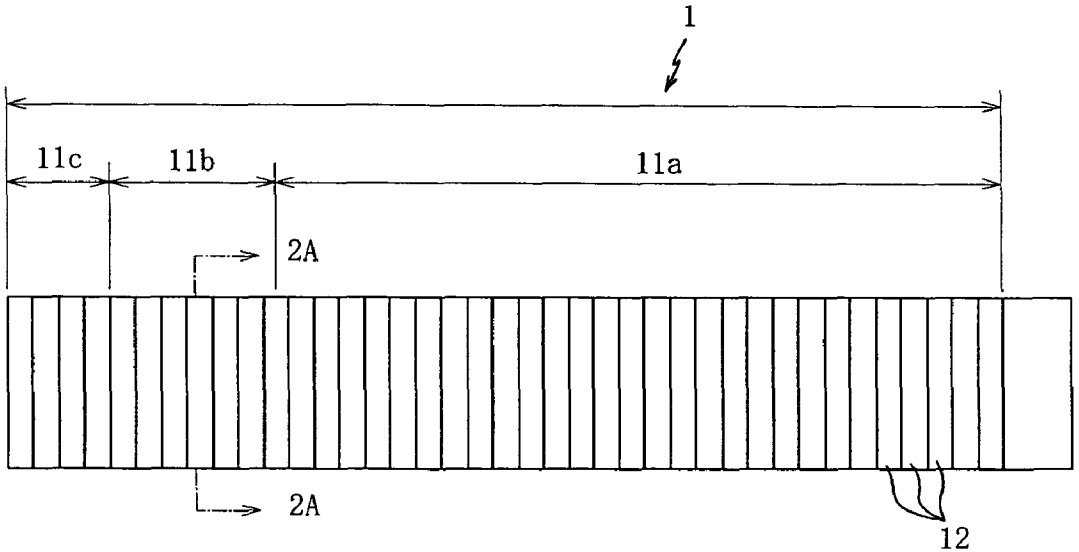
FIG. 1 A set of views showing a spline rolling tool according to an embodiment of the present invention, wherein views (a) and (b) are upper and side views of the spline rolling tool, respectively.

1 spline rolling tool
11 toothed 1 forming face
12 forming teeth
30 incomplete toothed region
30*a* curved surface portion
30*b* flat surface portion
30*c* inclined surface portion
40 chamfered edge
70 wire brush
72*a* bristle
100 spline
L single direction

BEST MODE FOR CARRYING OUT THE INVENTION

Figure 1B:
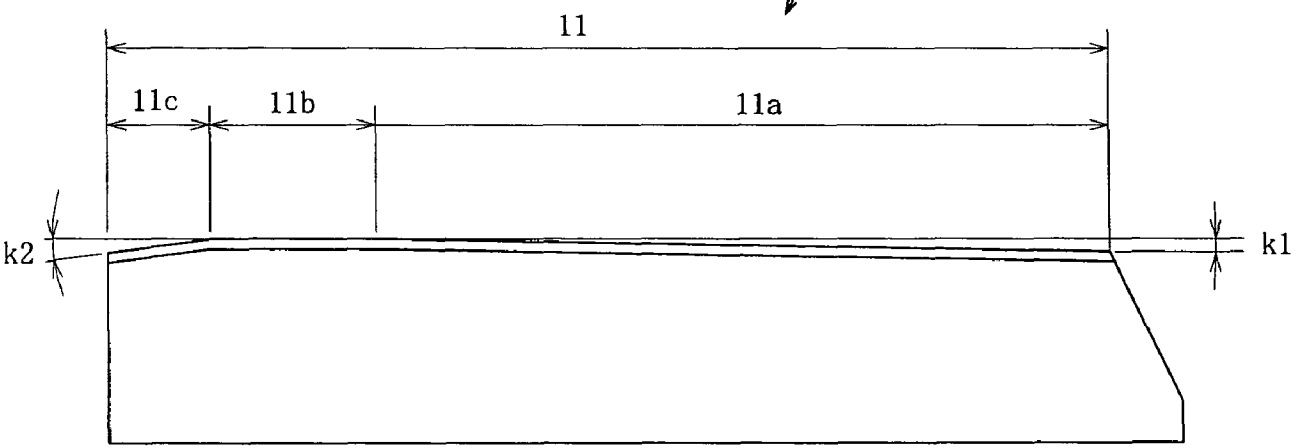

Hereinafter, a preferred embodiment of the present invention will be described with reference to the drawings. FIG. 1 is a set of views for explaining a spline rolling tool 1 according to an embodiment of the present invention, wherein views (a) and (b) are upper and side views of the spline rolling tool 1, respectively. It is noted that incomplete toothed regions 30 and chamfered edges 40 are not shown in FIG. 1.

Referring first to FIG. 1, an overall construction of the spline rolling tool 1 is described first. The spline rolling tool 1 is a tool that is to be used for causing plastic deformation on an outer circumferential surface of a workpiece provided by a cylindrical material so as to roll splines 100 (see FIG. 8) in each of which a shoulder 101*a* is provided in a ramped end portion of a root 101 of the spline 100.

In FIG. 1, one of a pair of spline rolling tools 1 that are to be fixed to a rolling apparatus (not shown) is shown, while the other of the spline rolling tools 1 that is to be parallelly moved relative to the one of the spline rolling tools 1 is not shown.

The spline rolling tool 1 has a generally elongated, rectangular-parallelepiped body, as shown in FIG. 1, which is made of alloy tool steel, high speed tool steel or other metallic material that is suitable for a rolling work. In an upper surface (which is located in a top side of a drawing sheet of view (a) of FIG. 1 and which is located in an upper side in view (b) of FIG. 1), a toothed forming face 11 is provided to roll the splines 100 (see FIG. 8) in the outer circumferential surface of the workpiece.

The toothed forming face 11 has a biting portion 11*a*, a finishing portion 11*b* and a relief portion 11*c*, as shown in FIG. 1, which are arranged in this order as seen in a direction from a rolling initiation or leading end (right end in FIG. 1) of the spline rolling tool 1 toward a trailing end (left end in FIG. 1).

The biting portion 11*a* is used so that the toothed forming surface 11 bites into an outer circumferential surface of the workpiece. As shown in view (b) of FIG. 1, the biting portion 11*a* is upwardly inclined with an inclination angle k1 as it extends from the leading end (right end in FIG. 1) of the spline rolling tool 1 to the finishing portion 11*b* left end in FIG. 1).

The finishing portion 11*b* is a portion serving for finishing the splines 100 (see FIG. 8) that are rolled in the workpiece by the biting portion 11*a*. As shown in view (b) of FIG. 1, the finishing portion 11*b* is substantially parallel with a supported surface (lower surface of the spline rolling tool 1.

The relief portion 11*c* is is a portion serving for releasing the workpiece from the toothed forming surface 11. As shown in view (b) of FIG. 1, the relief portion 11*c* is downwardly inclined with an inclination angle k2 as it extends from a terminal end of the finishing portion 11*b* to the trailing end (left end in FIG. 1) of the spline rolling tool 1.

On the toothed forming surface 11 constituted by the leading end portion 11*a*, the finishing portion 11*b* and the relief portion 11*c*, there are formed a plurality of tooth profiles (hereinafter referred to as "forming teeth") 12. The plurality of forming teeth 12 are successively arranged in a rolling feed direction (longitudinal direction of the rectangular-parallelepiped body of the spline rolling tool 1 corresponding to a horizontal direction as seen in FIG. 1) at a constant pitch that is dependent upon an outer circumferential dimension of the workpiece. Each of the forming teeth 12 is arranged to extend in a direction (vertical direction as seen in view (a) of FIG. 1) that is substantially perpendicular to the rolling feed direction. The workpiece is rolled and moved relative to the toothed forming surface 11 from the leading end toward the trailing end, whereby the splines 100 (see FIG. 8) are formed on the outer circumferential surface of the workpiece.

Figure 2A:
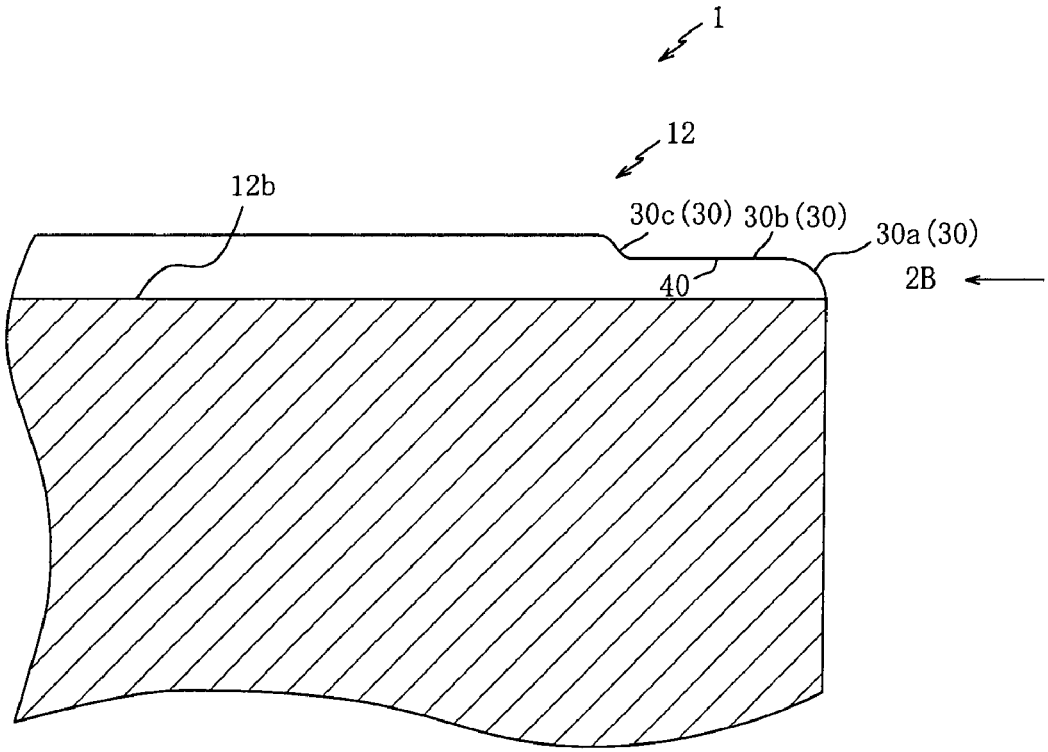
FIG. 2A A cross sectional view of the spline rolling tool, taken along line 2A-2A of view (a) of FIG. 1.
Figure 2B:
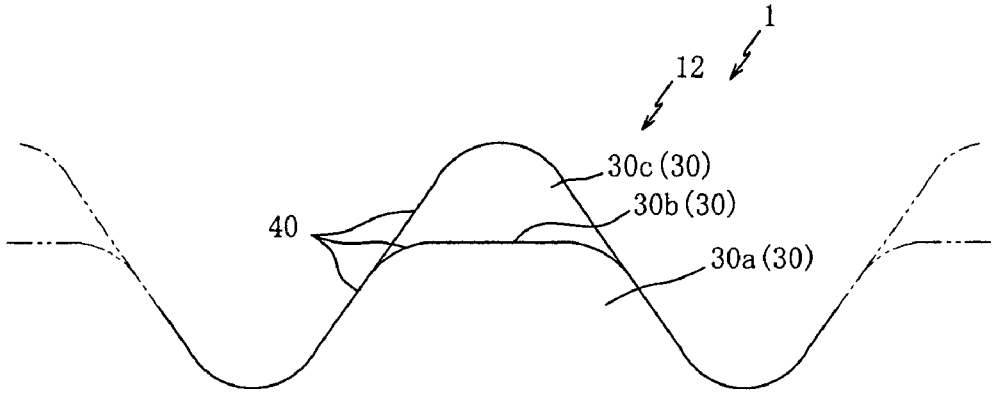
FIG. 2B A side view of the spline rolling tool, as seen from a direction of arrow 2B of FIG. 2A.

Referring next to FIGS. 2A and 2B, there will be described a construction of each of the forming teeth 12 in detail. FIG. 2A shows a cross sectional view of the spline rolling tool 1, taken along line 2A-2A of view (a) of FIG. 1, while FIG. 2B shows a side view of the spline rolling tool, as seen from a direction of arrow 2B of FIG. 2A. It is noted that FIG. 2A corresponds to a cross sectional view taken along a tooth root line 12*b* of each of the forming teeth 12.

As described above, each of the forming teeth 12 is a portion that is to bite into the outer circumferential surface of the workpiece, so as to plastically deform the outer circumferential surface of the workpiece, for thereby rolling the splines 100. As shown in FIGS. 2A and 2B, each of the forming teeth 12 includes an incomplete toothed region 30 which is located in an end portion (right end in FIGS. 2A and 2B) as viewed in a width direction of the forming tooth 12 (horizontal direction in FIG. 2A) and which is formed by a crest removing operation. Each of the forming teeth 12 further includes a chamfered edge 40 which is a periphery of an incomplete-toothed region surface in the incomplete toothed region 30 and which is formed by a chamfering operation.

Figure 8:
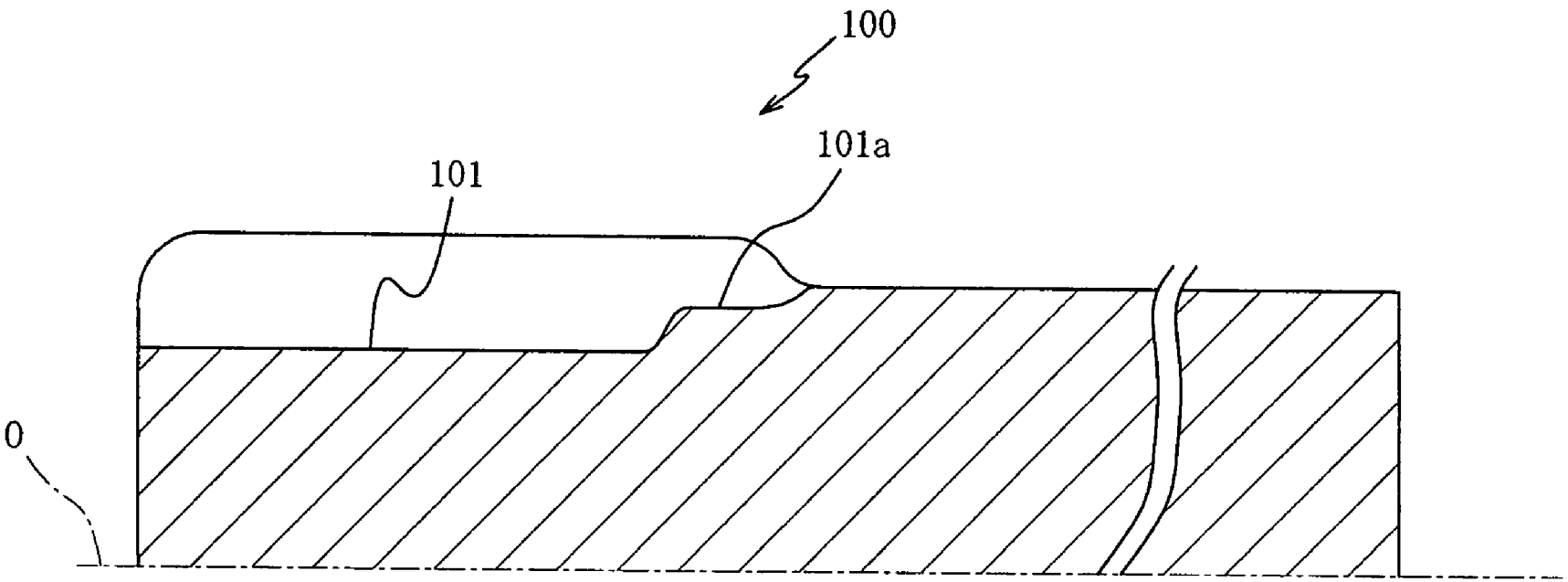
FIG. 8 (Prior Art)
FIG. 8 A cross sectional view of a spline having a shoulder.

The incomplete toothed region 30 is a region in which a height of the tooth is relatively low, so that the shoulder 101*a* can be formed in the root 101 of the spline 100 (see FIG. 8). As shown in FIGS. 2A and 2B, in the incomplete toothed region 30, a crest of each forming tooth 12 is removed such that an upper end of each forming tooth 12 is defined by the incomplete-toothed region surface that is constituted principally by a curved surface portion 30*a*, a flat surface portion 30*b* and an inclined surface portion 30*c*.

As shown in FIGS. 2A and 2B, the curved surface portion 30*a* is located in an end portion (right end in FIG. 2A) as viewed in a width direction of the forming tooth 12 (horizontal direction in FIG. 2A), and is formed to have an arcuate cross-section. The flat surface portion 30*b* is contiguous to the curved surface portion 30*a*, and is formed to be substantially parallel to the crest of the forming tooth 12. The slant surface portion 30*c* is contiguous to the flat surface portion 30*b*, and is formed to be inclined upwardly as it extends from the flat surface portion 30*b* to another end portion (left end in FIG. 2B) as viewed in the width direction of the forming tooth 12.

Where the splines are rolled in the workpiece by this spline rolling tool 1, each of the splines can be formed such that a root diameter defined by the roots of the respective splines is changed in a direction of an axis of the workpiece and such that a shoulder having a large diameter is formed in a ramped end portion of each of the splines (see FIG. 8). Consequently, it is possible to roll the splines in each of which a torsional strength of the ramped end portion is improved.

Where the forming teeth 12 are subjected to the crest removing operation to form the respective incomplete toothed regions 30, the periphery of each incomplete toothed region 30 would become a sharp edge whereby durabilities of the forming teeth 12 and splines could be reduced. In view of this, in the spline rolling tool 1 of the present invention, the periphery of each incomplete toothed region 30 is subjected to a chamfering operation, as described below, whereby the chamfered edge 40 is formed in the periphery of each incomplete toothed region 30.

Owing to the formation of the chamfered edge 40, it is possible to restrain chipping or other damage of each of the forming teeth 12 and accordingly to improve durability of the spline rolling tool 1. Further, by using this spline rolling tool 1, it is possible to restrain formation of an angular portion in the ramped end portion of each of the splines, so that the splines each having a high strength can be rolled in the workpiece.

The chamfered edge 40 is formed in the periphery of the incomplete-toothed region surface of the incomplete toothed region 30 to have a rounded cross-section (see FIG. 5), by a wire brush 70 (see FIG. 6) having a plurality of bristles 72*a* to which abrasive grains adhere, as described below.

Further, the chamfered edge 40 is formed to have a surface roughness of not larger than about 3.2 μm. Therefore, by using this spline rolling tool 1, it is possible to improve a surface smoothness of the ramped end portion of each of the splines, so that the splines each having a high strength can be rolled in the workpiece. Consequently, the durability of each of the splines can be improved.

Figure 3:
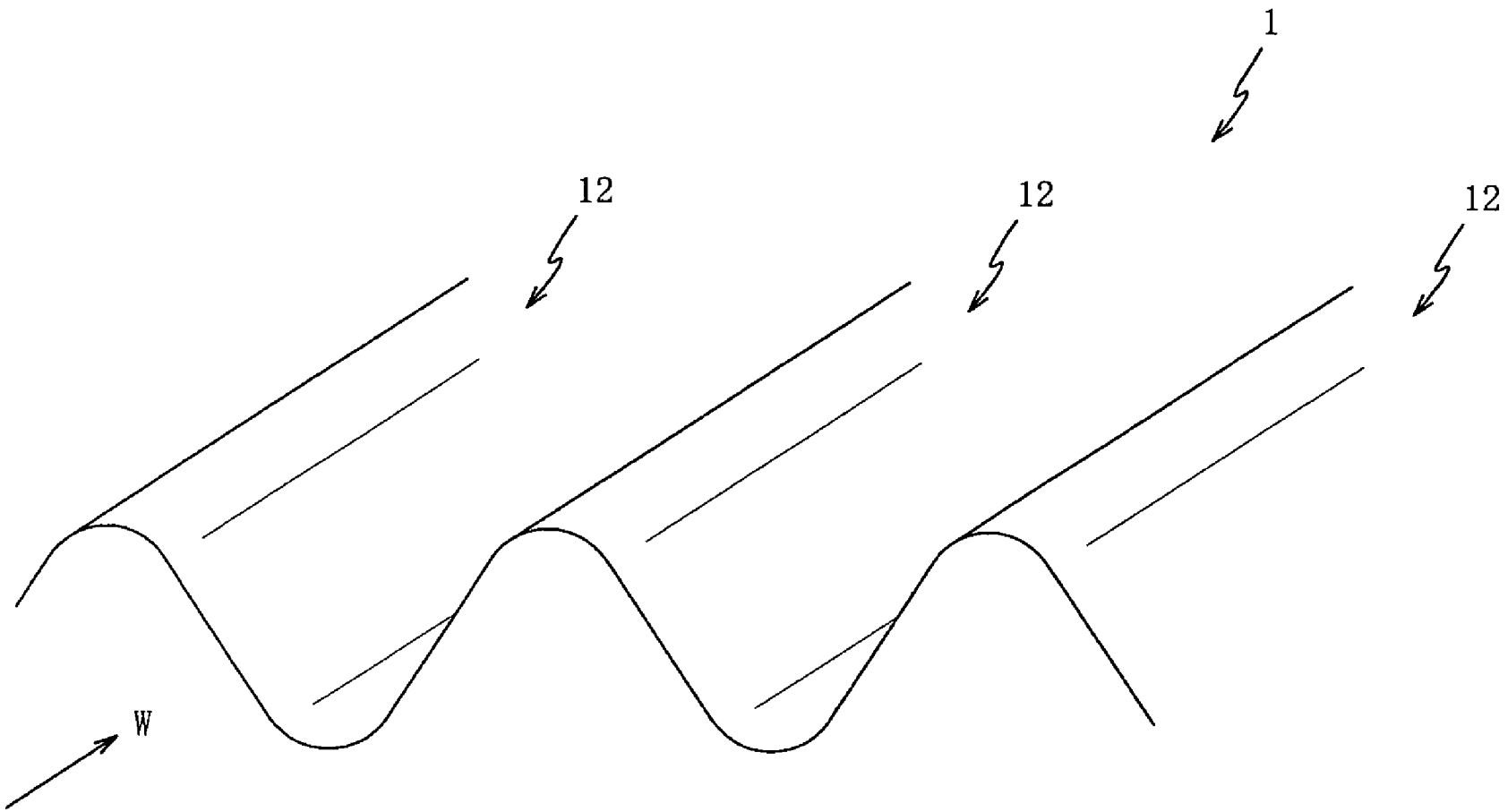
FIG. 3 A perspective view of forming teeth that are ground to be formed in a teeth forming step.
Figure 4:
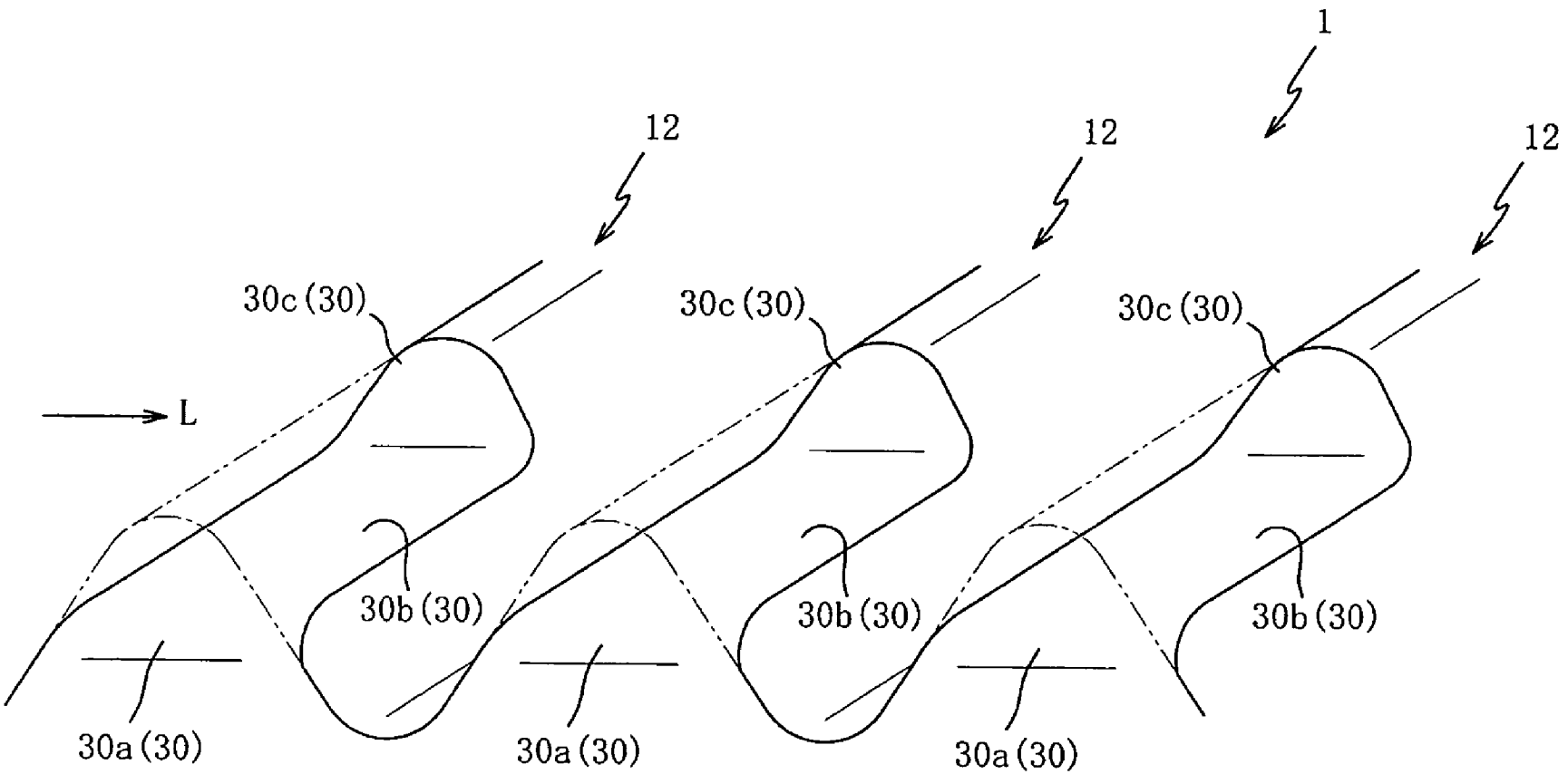
FIG. 4 A perspective view of the forming teeth in each of which an incomplete toothed region is formed by a crest removing operation in a crest removing step.
Figure 5:
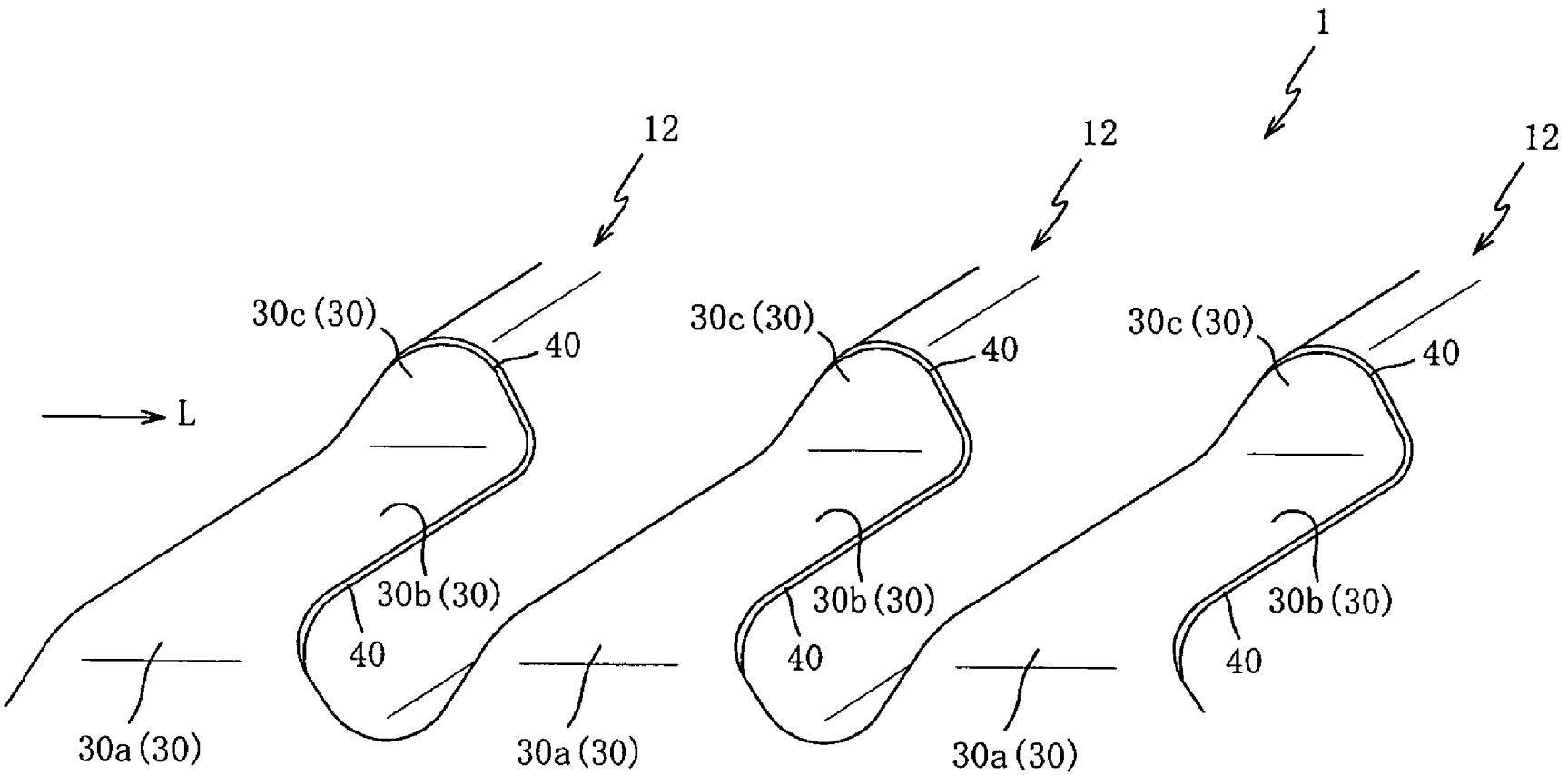
FIG. 5 A perspective view of the forming teeth in each of which a chamfering edge is formed by a chamfering operation in a chamfering step.

Referring next to FIGS. 3-5, there will be described a process of manufacturing the spline rolling tool 1. FIG. 3 is a perspective view of the forming teeth 12 that have been ground in a teeth forming step. FIG. 4 is a perspective view of the forming teeth 12 in each of which the incomplete toothed region 30 that has been formed in a crest removing step. FIG. 5 is a perspective view of the forming teeth 12 in each of which the chamfering edge 40 has been formed in a chamfering step.

For manufacturing the spline rolling tool 1, a die material made of a metallic material such as alloy tool steel and high-speed tool steel is first cut to have a substantially rectangular parallelepiped shape, and is then subjected to a heat treatment. Then, the forming teeth 12 are formed in a surface of the die material that has been subjected to the heat treatment, by a grinding operation using a grinding wheel (teeth forming step).

That is, in the teeth forming step, by rotating the grinding wheel having a disk shape while parallelly moving the grinding wheel in a direction of arrow W shown in FIG. 3 (width direction of the spline rolling tool 1, i.e., vertical direction in view (a) of FIG. 1), the multiplicity of forming teeth 12 are formed in the toothed forming face 11 (see FIG. 1), as shown in FIG. 3.

The grinding wheel used in the teeth forming step has a cross section that is configured to correspond to a cross sectional shape of one or two forming teeth 12 (one or two grooves between the forming teeth 12) (i.e., shape defined by arcuate portions of teeth roots and crests, and straight line portions connecting the arcuate portions). In common case, one or two forming teeth 12 (one or two grooves between the forming teeth 12) are formed by one stroke movement of the grinding wheel in the direction of arrow W.

In the present embodiment, a total of 243 forming teeth 12 (188 forming teeth in the leading portion 11*a*, 43 forming teeth in the finishing portion 11*b*, and 12 forming teeth in the relief portion 11*c*) are formed. Each forming tooth 12 has a height of about 0.975 mm as a maximum value. A pitch between the forming teeth 12 (as measured in the rolling direction) is about 2.503 mm.

After the teeth forming step, the crest removing step is implemented to carry out a crest removing operation on the forming teeth 12. In the crest removing step, as in the teeth forming step, a grinding wheel having a disk shape is rotated and parallelly moved in a direction of arrow L shown in FIG. 4 (direction substantially perpendicular to the width direction of each forming tooth 12, i.e., direction substantially perpendicular to the vertical direction in view (a) of FIG. 1), for thereby carrying out the crest removing operation in the end portion as viewed in the width direction of the forming tooth 12, so as to form the incomplete toothed regions 30 in the respective forming teeth 12, as shown in FIG. 4.

The grinding wheel used in the crest removing step has a cross section that is configured to correspond to a shape of a cross section of each forming tooth 12 in the incomplete toothed region 30 (i.e., a shape of a cross section created by a plane cutting each forming tooth 12 in the incomplete toothed region 30 and parallel to the width direction of the forming tooth 12). In common case, the plurality of forming teeth 12 are successively subjected to the crest removing operation, by one stroke movement of the grinding wheel in the direction of arrow L, so as to form the incomplete toothed region 30 (in which the upper end of each forming tooth 12 is defined by the incomplete-toothed region surface that includes the curved surface portion 30*a*, the flat surface portion 30*b* and the inclined surface portion 30*c*) in each forming tooth 12, as shown in FIG. 4.

In the present embodiment, an amount of removal of an upper portion of each forming tooth 12 (i.e., a distance between the crest of each forming tooth 12 and the flat surface portion 30*b*) is about 0.238 mm. A radius of curvature of the curved surface portion 30*a* is about 5.5 mm. An inclination angle of the inclined surface portion 30*c* (i.e., an angle defined between the flat surface portion 30*b* and an extension of the inclined surface portion 30*c*) is about 12°. A length of the incomplete toothed region 30 (as measured in the widthwise direction of each forming tooth 12) is about 7.5 mm.

Where the forming teeth 30 are subjected to the crest removing operation in the crest removing step, the periphery of the incomplete-toothed region surface of the incomplete toothed region 30 would become a sharp edge, and burrs could be left in the periphery, whereby the forming teeth 12 could be easily chipped or otherwise damaged. Further, an angular portion could be formed in each of the splines 100 that are rolled by such forming teeth 12, so that each spline 100 could suffer from a stress concentrated at the angular portion.

Figure 6:
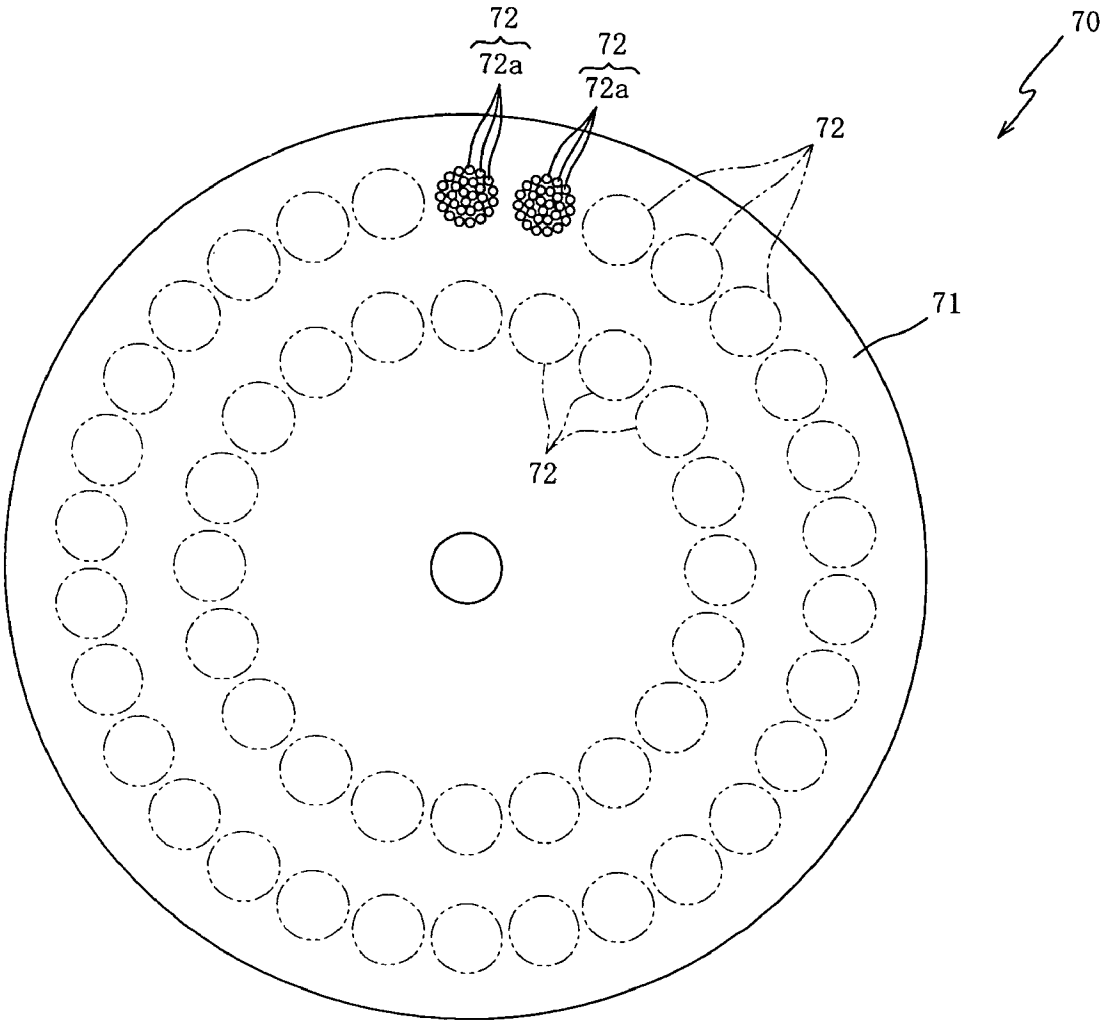
FIG. 6 A bottom view of a wire brush.
Figure 7:
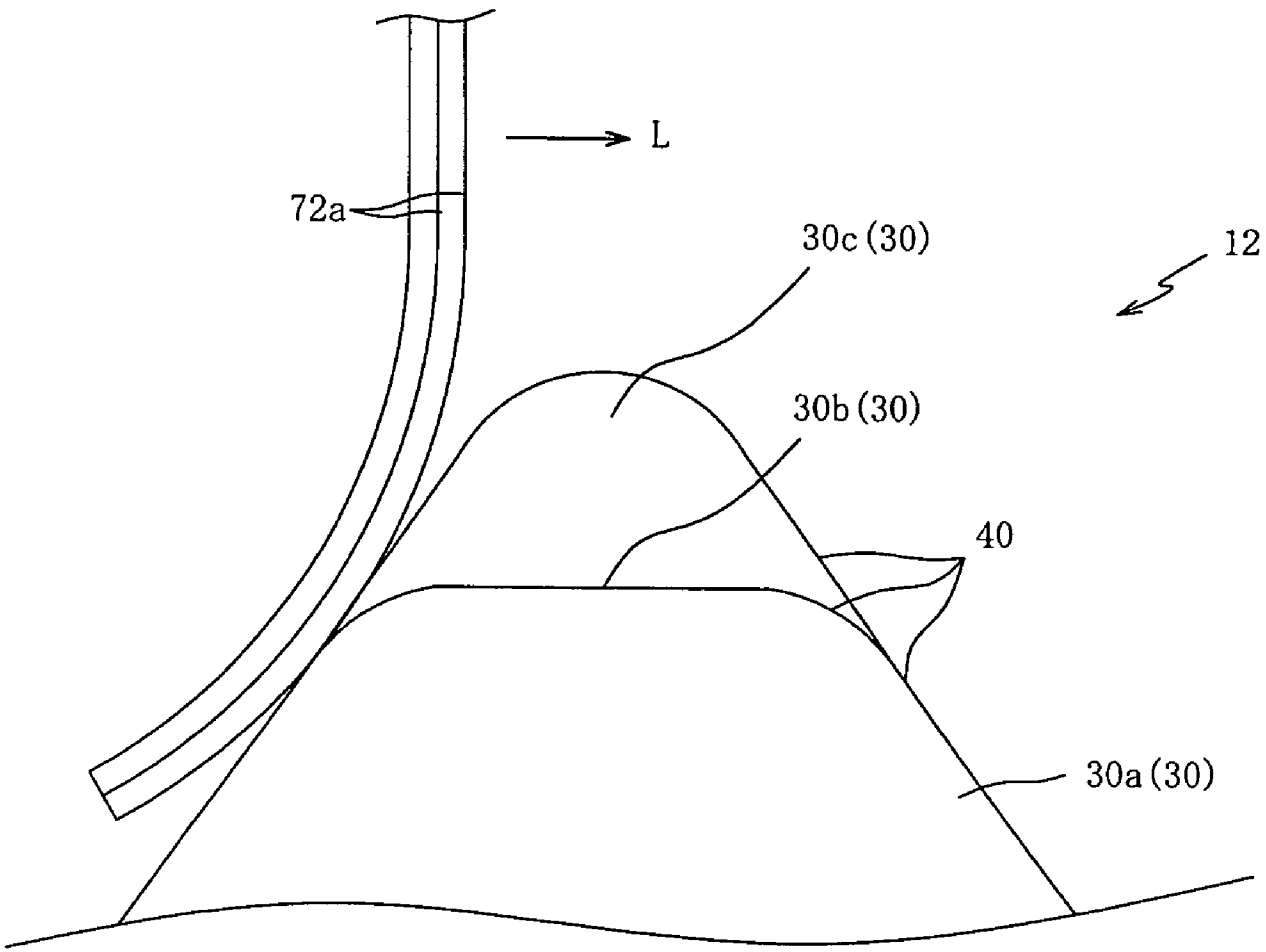
FIG. 7 A schematic view schematically showing the chamfering operation performed on the forming tooth by the wire brush.

For avoiding such a problem, after the crest removing operation in the crest removing step, the chamfering step is implemented to carry out the chamfering operation on the forming teeth 12. The chamfering operation is carried out by using the wire brush 70. Referring now to FIGS. 6 and 7, there will be described a construction of the wire brush 70 in detail.

FIG. 6 is a bottom view of the wire brush 70. In FIG. 6, only some of a multiplicity of bristle clusters 72 is illustrated by solid lines, while the other bristle clusters 72 are schematically illustrated by two-dot chain lines.

As shown in FIG. 6, the wire brush 70 is constituted to have the multiplicity of bristle clusters 72 disposed on a bottom surface of a substrate member 71. In the present embodiment, the substrate member 71 is provided by a disk-shaped body made of aluminum alloy and having a diameter of about 150 mm. The bristle clusters 72 are arranged in two lines extending along respective two virtual circles that are coaxial with an axis of the disk-shaped substrate member 71. The bristle clusters 72 arranged in a radially inner one of the two lines are disposed in a total of 20 portions that are circumferentially spaced apart from each other by an angular pitch of about 18°. The bristle clusters 72 arranged in a radially outer one of the two lines are disposed in a total of 30 portions that are circumferentially spaced apart from each other by an angular pitch of about 12°.

Each of the bristle clusters 72 consists of total of 30 bristles 72*a* that are densely located within a virtual circle having a diameter of about 10 mm. Each of the bristles 72*a* is provided by a line-shaped resin material such as nylon, to which abrasive grains adhere (or which contain the abrasive grains). Each of the bristles 72*a* has a diameter of about 1 mm, and a length (i.e., dimension of its projection from the bottom surface of the substrate member 71) of about 13 mm. The abrasive grains are provided by GC (Green Carbon Random) as grain material, and has a grain size of #120.

FIG. 7 is a schematic view schematically showing the chamfering operation performed on the forming teeth 12 by the wire brush 70. The wire brush 70 is rotated about the axis of the disk-shaped substrate member 71, and is moved in the direction indicated by arrow L shown in FIG. 7. In this instance, the bristles 72*a* are moved while being flexed to have an arcuate shape, as shown in FIG. 7, so as to follow the complicated shape of the incomplete-toothed region surface of the incomplete toothed region 30. Therefore, the periphery of the incomplete-toothed region surface of the incomplete toothed region 30 can be chamfered to have an arcuate cross sectional shape that is constant over an entirety of the periphery of the incomplete-toothed region surface of the incomplete toothed region 30'.

If the chamfering is performed by a handwork operation as conventionally practiced, the forming teeth 12 could be chamfered too much, thereby resulting in problematic reduction in a non-chamfered portion of each of the forming teeth 12. In the present invention, however, since it is possible to cause the bristles 72 of the wire brush 70 to cut an angular portion of each of the forming teeth 12 having a relatively low rigidity, it is possible to assuredly obtain the non-chamfered portion of each of the forming teeth 12. Consequently, it is possible to improve accuracy in fitting of each of the splines that is rolled in the workpiece.

Referring back to FIG. 5, the chamfering operation is described. In the chamfering operation, the wire brush 70 constructed as described above is parallelly moved in the direction indicated by arrow L shown in FIG. 5 (the same direction as the direction of arrow L in FIG. 4) while being rotated, whereby the chamfering operation is performed on the forming teeth 12 by the abrasive grains adhering to the bristles 72*a* of the wire brush 70. Thus, the chamfered edge 40 is formed in the periphery of the incomplete-toothed region surface of the incomplete toothed region 30, as shown in FIG. 5.

In the chamfering operation, the plurality of forming teeth 12 (the peripheries of the incomplete-toothed region surface of the incomplete toothed regions 30) are successively subjected to the crest removing operation, by one stroke movement of the wire brush 70 in the direction of arrow L, thereby making it possible to complete the chamfering step in an extremely short length of time.

That is, the chamfering operation can be performed successively on the multiplicity of forming teeth 12 provided in the toothed forming face 11, without having to carry out a complicated operation such as a machining operation with use of a numerically controlled machine tool in which a grinding wheel is fed through a three controllable axes of the machine tool so as to be moved along the periphery of the incomplete-toothed region surface of the incomplete toothed region 30 of every one of the multiplicity of forming teeth 12 of the toothed forming face 11. Consequently, it is possible to simplify the chamfering step and accordingly to remarkably reduce a time required to carry out the chamfering operation, thereby leading to reduction in the machining cost and consequent reduction in cost for manufacturing the spline rolling tool 1.

Further, since the direction (direction of arrow L) of the parallel movement of the wire brush 70 is substantially perpendicular to the width direction of each of the forming teeth 12, it is possible to cause each of the bristles 72*a* of the wire brush 70 to be appropriately brought into contact with the periphery of the incomplete-toothed region surface of the incomplete toothed region 30. Accordingly, it is possible to efficiently and reliably carry out the chamfering operation, even in a case where the incomplete-toothed region surface of the incomplete toothed region 30 is a complicated shape having the curved surface portion 30*a*, the flat surface portion 30*b* and the slant surface portion 30*c* as in the present invention.

Further, since the direction (direction of arrow L) of the parallel movement of the wire brush 70 coincides with the direction (direction of arrow L) of the movement of the grinding wheel for the crest removing operation performed on the forming teeth 12, it is possible to suitably remove burrs by the bristles 72*a* of the wire brush 70, if the burrs are left in the peripheries of the incomplete-toothed region surfaces of the respective incomplete toothed regions 30 after the crest removing operation.

If the wire brush 70 were parallelly moved in a direction (direction of the width of each forming tooth 12) substantially perpendicular to the direction of arrow L, a direction of displacement of each of the bristles 72*a* as a result of rotation of the wire brush 70 would be substantially perpendicular to the width direction of each forming tooth 12, so that the burrs removed by the bristles 72*a* would be slid, together with the bristles 72*a*, on the incomplete-toothed region surfaces and the chamfered edges 40 in the incomplete toothed regions 30, thereby damaging the surfaces of the incomplete-toothed region surfaces and the chamfered edges 40.

On the other hand, since the wire brush 70 is parallelly moved in the direction of arrow L, the direction of displacement of each of the bristles 72*a* as a result of rotation of the wire brush 70 coincides with the width direction of each forming tooth 12, thereby making it possible for the bristles 72*a* to carry the removed burrs away from the forming teeth 12. Thus, the chamfering operation can be performed to form the chamfered edges 40, without damaging the incomplete-toothed region surfaces and the chamfered edges 40 by the removed burrs.

The wire brush 70 is fixed in a height position permitting distal ends of the respective bristles 72*a* to be aligned with lower ends of the respective incomplete-toothed region surfaces of the curved surface portion 30*a*, and is parallelly moved in the direction of arrow L shown in FIG. 5 while being fixedly held in such a height position. In the present embodiment, while the wire brush 70 is held in the height position, the distal ends of the respective bristles 72*a* are positioned to be lower than the crests of the forming teeth 12, by about 5.738 mm that corresponds to a sum of about 0.238 mm as the amount of removal of the upper portions of the respective forming teeth 12 and about 5.5 mm as the radius of curvature of the curved surface portions 30*a*.

While the present invention has been described based on the embodiment, it is to be easily imagined that the present invention is not at all limited to the details of the above-described embodiment but may be subjected to various improvements and modifications within a range that is not deviated from the gist of the invention.

For example, numerical values described above in the description of the embodiment are merely examples, and the numerical values may be changed as needed.

Further, the present invention is not limited to the above-described embodiment in which the crest removing operation is performed on only the one widthwise end portion of each forming tooth 12. That is, the crest removing operation may be performed on widthwise opposite end portions of each forming tooth 12.

The invention claimed is:

1. A spline rolling tool for rolling splines on an outer circumferential surface of a workpiece, comprising:

an elongated rectangular parallelepiped body having a toothed forming face with which the workpiece is to be brought into rolling contact at the outer circumferential surface thereof; and a plurality of forming teeth which are provided on said toothed forming face, and which are to bite into the outer circumferential surface of the workpiece so as to roll the splines on the outer circumferential surface of the workpiece, wherein said forming teeth are arranged in a longitudinal direction of said elongated rectangular parallelepiped body, wherein each of said forming teeth has an incomplete toothed region located in one of two end portions of each of said forming teeth where the two end portions are opposite to each other in a width direction of said elongated rectangular parallelepiped body, wherein a crest of each of said forming teeth is removed in said incomplete toothed region such that an upper end of each of said forming teeth in said incomplete toothed region is defined by an incomplete-toothed region surface that includes (a) a curved surface portion contiguous to a widthwise end surface of said elongated rectangular parallelepiped body and having an arcuate shape in a cross section that is perpendicular to said longitudinal direction, (b) a flat surface portion having a first end and a second end, wherein the first end is contiguous to said curved surface portion and substantially parallel to said crest of each of said forming teeth, and (c) a slant surface portion contiguous to the second end of said flat surface portion and inclined upwardly toward another one of said two end portions of each of said forming teeth, and wherein said incomplete-toothed region surface has a chamfered edge throughout a periphery thereof where said chamfered edge has a surface roughness of not larger than about 3.2 μm.

2. The spline rolling toll according to claim 1, wherein said chamfered edge is a rounded surface having a rounded cross section.

3. The spline rolling tool according to claim 1, wherein said chamfered edge is formed by a wire brush having abrasive grains that are fixed to bristles of the wire brush.

4. A process of manufacturing the spline rolling tool recited in claim 1, comprising the following steps of:

forming a teeth on said toothed forming face;

removing a crest of each of said forming teeth in said incomplete toothed region such that said upper end of each of said forming teeth in said incomplete toothed region is defined by said incomplete-toothed region surface; and chamfering an edge defining said periphery of said incomplete-toothed region surface, so as to form said chamfered edge provided by a rounded surface having a rounded cross section, wherein said step of chamfering the edge is implemented by using a wire brush having abrasive grains that are fixed to bristles of the wire brush.

5. The process according to claim 4, wherein said step of chamfering the edge is conducted by rotating said wire brush while moving said wire brush relative to said elongated rectangular parallelepiped body in a predetermined direction.

6. The process according to claim 5, wherein said predetermined direction substantially coincides with said longitudinal direction in which said forming teeth are arranged.

7. The process according to claim 6, wherein said wire brush is straightly moved along said toothed forming face.

8. The process according to claim 7, wherein said wire brush includes a disk-shaped body having a bottom surface from which said bristles project, and wherein said wire brush is moved and rotated about an axis of said disk-shaped body, while said disk-shaped body being held in substantially parallel with said toothed forming face, with a distance between said disk-shaped body and said toothed forming face being held substantially constant.

9. The process according to claim 6, wherein said step of chamfering the edge is implemented such that the chamfered edges defining the respective peripheries of the incomplete-toothed region surfaces of the respective forming teeth are all formed by a single stroke movement of the rotated wire brush along said toothed forming face in said longitudinal direction.

10. The process according to claim 4, wherein said step of removing the crest is implemented such that said crest of each of said forming teeth is removed in said incomplete toothed region by moving a grinding wheel relative to said elongated rectangular parallelepiped body in a direction substantially coinciding with said longitudinal direction in which said forming teeth are arranged.

* * * * *

UNITED STATES PATENT AND TRADEMARK OFFICE

CERTIFICATE OF CORRECTION

PATENT NO. : 7,908,897 B2
APPLICATION NO. : 11/666466
DATED : March 22, 2011
INVENTOR(S) : Igarashi et al.

It is certified that error appears in the above-identified patent and that said Letters Patent is hereby corrected as shown below:

Title page item [75]
Inventors: "Nobuyoshi Asaga" is corrected to --Nobuyoshi Asaka--

Signed and Sealed this
Fifth Day of July, 2011

David J. Kappos

David J. Kappos
*Director of the United States Patent and Trademark Office*